United States Patent [19]

Kruzan et al.

[11] 4,021,064

[45] May 3, 1977

[54] CAM HOOK FOR SNUGGING DOORS

[75] Inventors: Albert W. Kruzan; Loren P. Boppart, both of Harvard, Ill.; Charles M. Bland, Beloit, Wis.

[73] Assignee: Chromalloy American Corporation, New York, N.Y.

[22] Filed: May 27, 1975

[21] Appl. No.: 580,948

[52] U.S. Cl. ..... 292/111; 292/65

[51] Int. Cl.[2] ..... E05C 5/00; E05C 19/12

[58] Field of Search ..... 292/111, 113, 65, 66, 292/246, 247; 52/754, 757

[56] References Cited

UNITED STATES PATENTS

| | | | |
|---|---|---|---|
| 1,449,576 | 3/1923 | Anderson | 292/111 |
| 3,377,091 | 4/1968 | Pastra | 292/65 |
| 3,528,690 | 9/1970 | Langer | 52/757 |

*Primary Examiner*—Robert L. Wolfe
*Attorney, Agent, or Firm*—Wegner, Stellman, McCord, Wiles & Wood

[57] ABSTRACT

A hook member for securing and snugging a door of a structure such as a barn is provided with a cam lever which may be manually rotated after the hook member is engaged with a latch bar on the door to move the hook member longitudinally away from the door and thus pull the door snugly against the portion of the structure on which the hook member is mounted. The cam hooks of the invention may be mounted inside a building to snug the rear edge portions of single or double sliding doors against the building wall, or to snug the front edge portion of a single sliding door or of a hinged door against the jamb; and may also be used to snug the forward edges of a pair of double sliding doors together either from the inside or from the outside.

14 Claims, 8 Drawing Figures

10
13a
13
12
27
17
28
29
19
24
23
16
15
22
20
24
34
31
18
11
14

40
10
27
34
40b
35
31
29
17
39
27
19
36
32
41
18
33
11
13
15
16
24
20
22
21
14
12

41
19
27
36
10
13
11
34
39
17
29
15
33
31
18
24
16
37
20
40
35
27
32
12
21
14

5.
27
17
10
12
13
15
40
29
31
39
19
36
41
33
23
24
22
34
37
25
26
20
11
35
27
32
18
21
14
5.

12
13
15
13a
11
17
37
30
28
29
19
36
20
16
23
40b
31
38
26
34
35
39
39a
18
32
41
25
24
40a
40
20

CAM HOOK FOR SNUGGING DOORS

BACKGROUND OF THE INVENTION

Many farm buildings and industrial buildings have track-hung sliding doors with inwardly facing exposed vertical and horizontal frame members, and metal or wood sheathing secured to the outer faces of the frame members. The building may have a single sliding door, or double sliding doors. There must, of course, be enough clearance between the door and the building wall to avoid interference as the door is moved. When such doors are closed there is an undesirable amount of space between the doors and the jamb, and wind may swing such doors in and out. It is very desirable to snug the door or doors against the wall and to snug double sliding doors against each other to reduce drafts, conserve heat, and eliminate objectionable banging of the doors in a wind.

U.S. Pat. No. 3,481,078, owned by applicants' assignee, discloses a device for snugging sliding doors which has enjoyed considerable commercial success that would, however, have been greater except for the relatively high cost of the device.

Applicants' assignee has marketed a toggle type door snugging device which is also relatively objectionable because of its bulk and its cost. In those devices a latch operating lever is pivotally mounted between a pair of upstanding ears, and a latch hook is pivoted on the lever away from the door. With the lever in an elevated position the latch hook is free to be swung in and out of engagement with a bale on the door. Pivotal movement of the lever acts upon the latch hook with a toggle action to pull the hook endwise and thus snug the door.

It is also known to use a hook like a common screen door hook but with the shank of the hook in the form of a turn buckle so the shank may be effectively lengthened and shortened. The sleeve of a turnbuckle hook must be turned with a wrench in order to snug a door.

Finally, Simmmons Fastener Co. of Albany, New York, markets, under the name "Hook-Lock," a positive locking device for containers which must be very securely and positively locked under high closing pressure. The Simmons Hook-Lock is similar in principle to the toggle type device previously described, but it consists of two pivotally connected sheet metal elements which are in planes parallel to the mounting surface so as to occupy no more than one-half inch of space forward of said surface. The Simmons Hook-Lock could not be used as a door snugger.

SUMMARY OF THE INVENTION

The device of the present invention utilizes a modification of a conventional screen door hook which has a large loop that loosely encircles a stud so that the hook may be swung about the stud. A camming lever is pivotally mounted on the stud and has a pair of spaced bights which slidably receive the loop and loosely confine the hook member to swinging movement in a single plane which is commonly vertical. The bights and the loop cooperate in such a way that after the hook member has been engaged with a latch bar on a door, rotation of the lever in the direction of the door moves the hook member longitudinally rearwardly so as to draw the door firmly against the part of a building structure upon which the hook is mounted.

In the disclosed embodiments, the loop is substantially circular, and the camming lever has its loop engaging bights eccentrically positioned with reference to the stud.

In one form, the hook is mounted upon a wall where it engages a latch bar mounted on an interior door frame member so as to snug the adjacent end of the door against the jamb.

In another form, the hook and camming lever are mounted on one of a pair of sliding doors and engage a latch bar on the other door to snug the doors together. The rear edges of both doors may be snugged against the jambs by two cam hooks of the first type.

If a building has no personnel door but has double sliding doors, they may be snugged together by the device of the invention mounted on the outside of the doors.

The principal object of the invention is to provide a simple and inexpensive snugging device for track-mounted sliding doors or outwardly swinging hinged doors.

Yet another object of the invention is to provide such a device which is rugged, simple, and easy to install.

Yet another object of the invention is to provide a door snugging device which projects a very short distance from the surface upon which it is mounted.

THE DRAWINGS

DETAILED DESCRIPTION OF THE INVENTION

Figure 1:
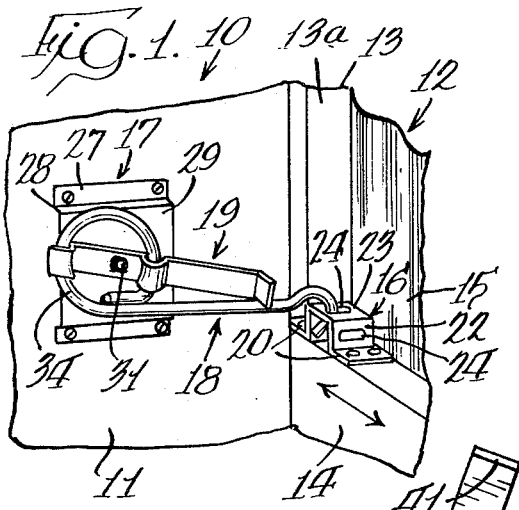
FIG. 1 is a fragmentary elevational view of a first embodiment of the invention with the parts in the position that they occupy when a sliding door is snugged against a building wall.

Referring to the drawings, and referring first to FIGS. 1 to 5, the apparatus of the invention is illustrated as applied to a structure, indicated generally at 10, which includes a wall 11 and a sliding door, indicated generally at 12. For further information respecting the nature of the structure 10 and the mounting of the sliding door, reference is made to U.S. Pat. No. 3,481,078, issued Dec. 2, 1969 to Robert G. Ferris. The door has a rectangular frame including a front upright frame member 13 and a transverse intermediate frame member 14 which are exposed toward the interior of the structure, and mounted on the outer faces of the door frame members is metal or wood sheathing 15.

The structure of the present invention includes, generally, a latch catch, indicated generally at 16, which is mounted upon the transverse intermediate door frame member 14 immediately adjacent the upright door frame member 13 which, in this instance, is at the forward edge of the door. The apparatus also includes a hook mounting bracket, indicated generally at 17, which is mounted upon the building wall 11 so that the latch catch 16 is adjacent the bracket 17 when the door is closed; and mounted upon the bracket 17 are a hook member, indicated generally at 18; and cam lever, indicated generally at 19.

The latch catch 16 is seen to include horizontal mounting flanges 20 which are secured to the top of the intermediate cross frame member 14, and depending fingers 21 which are secured to the external face of said frame member 14 inside the sheathing 15. Between the flanges 20 are upright webs 22 which are connected by a top web 23; and each of the webs is provided with a hole 24 so that the portion of the web between the hole and the interior edge 25 of the web forms a latch bar 26. The purpose of the holes 24 in the upright webs is to permit the latch catch 16 to be mounted upon the vertical face 13*a* of the upright frame member 13 if there is no transverse frame member, such as the member 14, at a convenient height for the mounting of the hook apparatus.

Figure 5:
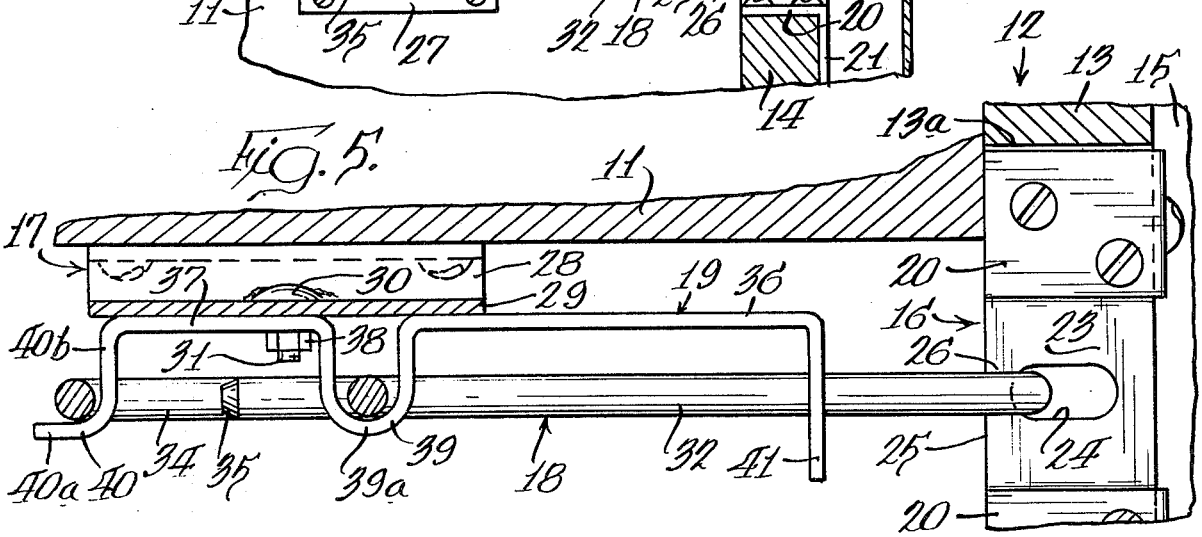
FIG. 5 is a horizontal sectional view on an enlarged scale taken substantially as indicated along the line 5—5 of FIG. 4.

The hook mounting bracket 17 includes mounting flanges 27, spacing webs 28, and a main web 29 which is centrally apertured to receive a headed bolt 30 which is welded to the main web 29 so as to provide a threaded stud 31. As seen in FIG. 5, both the latch bar 26 and the stud 31 are parallel to the inner face of the door.

The hook member 18 comprises a shank 32 which has a hook 33 at its forward end and a relatively large loop 34 at its rearward end which loosely encircles the stud 31. As is clear from the drawings, the hook member 18 is fabricated from metal rod such as that used to make large door hooks, and except for the large loop 34 the hook member 18 is like a conventional door hook. The loop 34 consists of a single turn of the rod, and the extremity 35 of the rod is inside the loop against the rearward end of the shank 32 between the shank and the stud 31.

The camming lever 19 has a long arm 36 and a short arm 37, and is impaled by the threaded stud 31 on which it is rotatably mounted by means of a nut 38. A first bight 39 which is positioned very close to the lever pivot provided by the stud 31, and a second bight 40 which is on the opposite side of and farther from the stud 31, provide eccentric means which slidably receives the loop 34 of the hook member 18. Thus the bights 39 and 40 are seen to be segments of a circle which is struck about a center X on the lever that is spaced from the stud 31. At the end of the lever arm 36 opposite the bight 40 is a finger piece 41 which projects outwardly a sufficient distance to lie in the plane of movement of the hook shank 32. The portions 39*a* and 40*a* of the bights 39 and 40 confine the hook member 18 loosely to movement in a predetermined plane, which is vertical as illustrated; while the portion 40*a* of the bight 40 acts as a camming surface to shift the location of the hook member 18 with reference to the stud 31 as the camming lever 19 is rotated about the stud.

Figure 2:
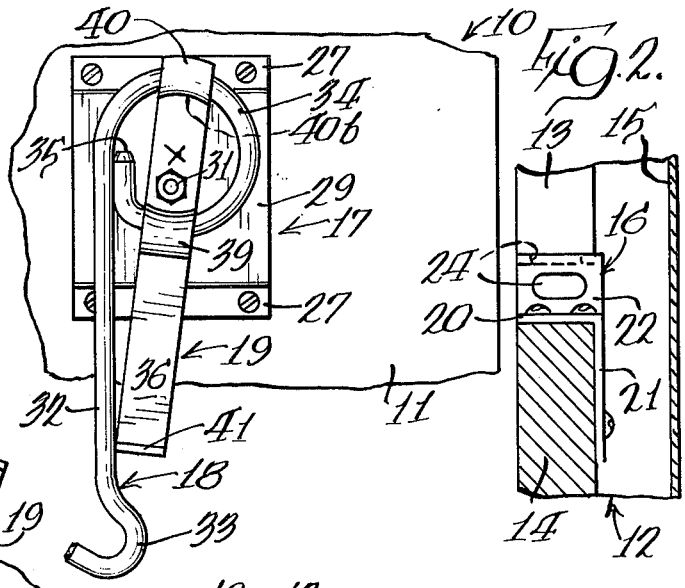
FIG. 2 is a view on a scale larger than FIG. 1 showing the hook member and camming lever in their idle positions and the door in a fragmentary sectional form to illustrate the latch catch.

In their idle position, illustrated in FIG. 2, it is seen that both the hook member 18 and the camming lever 19 are hanging downwardly from the hook bracket 17. When the hook 33 is to be engaged with the latch bar 26, the finger piece 41 of the cam lever 19 is grasped and the lever is rotated clockwise as illustrated in the drawings so that the finger piece pushes the hook around the stud 31 from the position of FIG. 2 until the hook member passes an upright position from which it falls by gravity until the hook 33 drops into the hole 24, at which point the parts occupy the position illustrated in FIG. 3. Continued rotation of the camming lever 19 about the stud 31 toward the door 12 causes the bights 39 and 40 to move from the position of FIG. 3 in which the center X is below the stud 31 to the position of FIG. 4 in which the center X is farther from the door than is the stud. This eccentric movement about the stud causes the camming surface 40*a* to push the hook member 18 longitudinally rearwardly so that engagement of the hook 33 with the latch bar 26 snugs the door against the building wall 11 as seen in FIGS. 4 and 5. In the fully snug position it is seen that the finger piece 41 rests on top of the hook shank 32.

Figure 3:
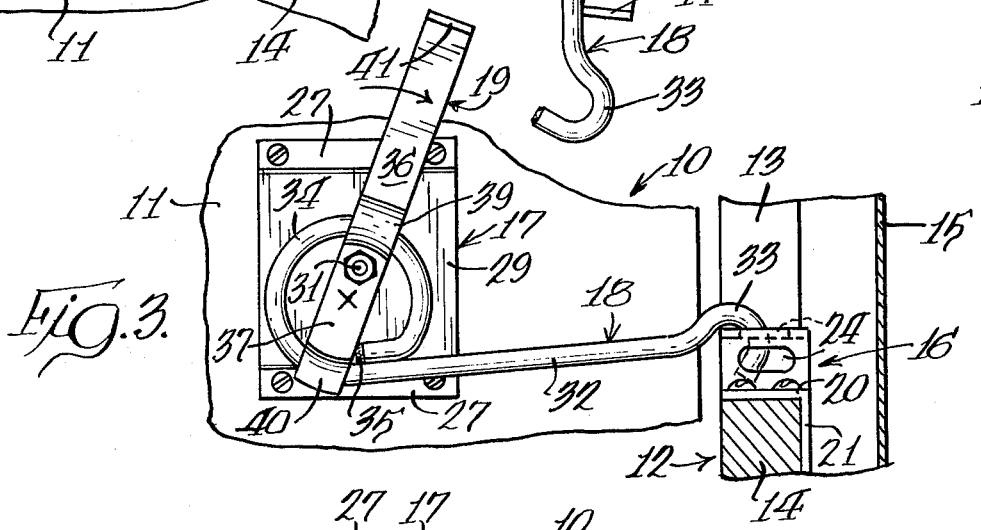
FIG. 3 is a view similar to FIG. 2 showing the hook engaged with the latch bar but with the door not yet snugged.
Figure 4:
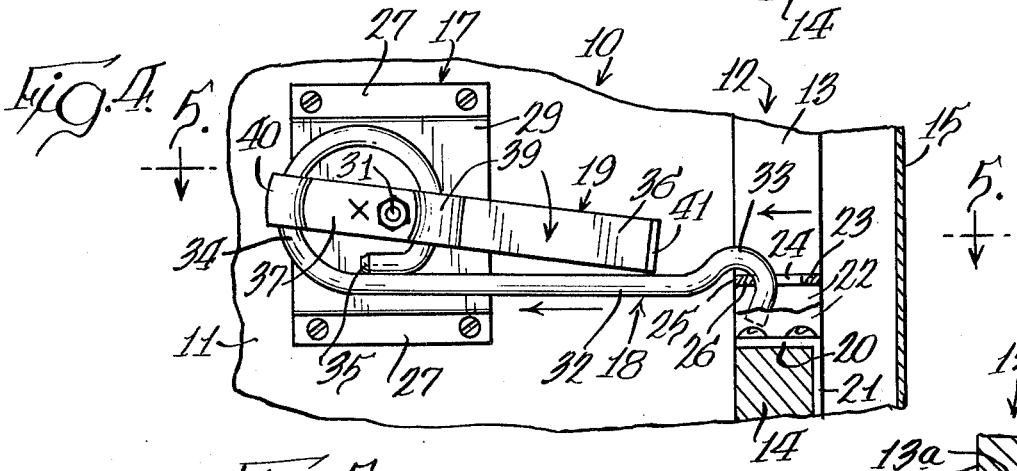
FIG. 4 is a view like FIGS. 2 and 3 but showing the parts in the same position illustrated in FIG. 1.

When the hook is to be disengaged, the camming lever 19 is rotated counterclockwise until the camming surface 40*a* abuts the end 35 of the rod inside the loop, as seen in FIG. 3, at which point the continued motion of the camming lever swings the hook member 18 to lift the hook 33 out of the hole 24, and further motion of the camming lever 19 moves the hook member 19 past the vertical where it swings by gravity until its shank 32 is again stopped by contact with the finger piece 41.

A significant feature of the invention is that when the camming lever 19 is moved to the terminal fully "snugged" position illustrated in FIG. 4 it is a few degrees below the position which produces the maximum rearward displacement of the hook member 18 of 118. This places it in an overcenter position from which it cannot be dislodged by shaking or bumping of the door.

Further, the rod stock from which the hooks are fabricated allows sufficient resilience in the loop 34 that the pressure applied to the rear side of the loop by the camming surface 40*a* of the camming lever 19 distorts the loop slightly; and the resilience of the loop maintains full tension of the hook member 18 against the latch bar even though the camming lever has passed over center. Thus, the first movement of the camming lever from the position of FIG. 4 toward the position of FIG. 2 requires more force than is necessary once the camming lever has passed its dead center position.

Figure 6:
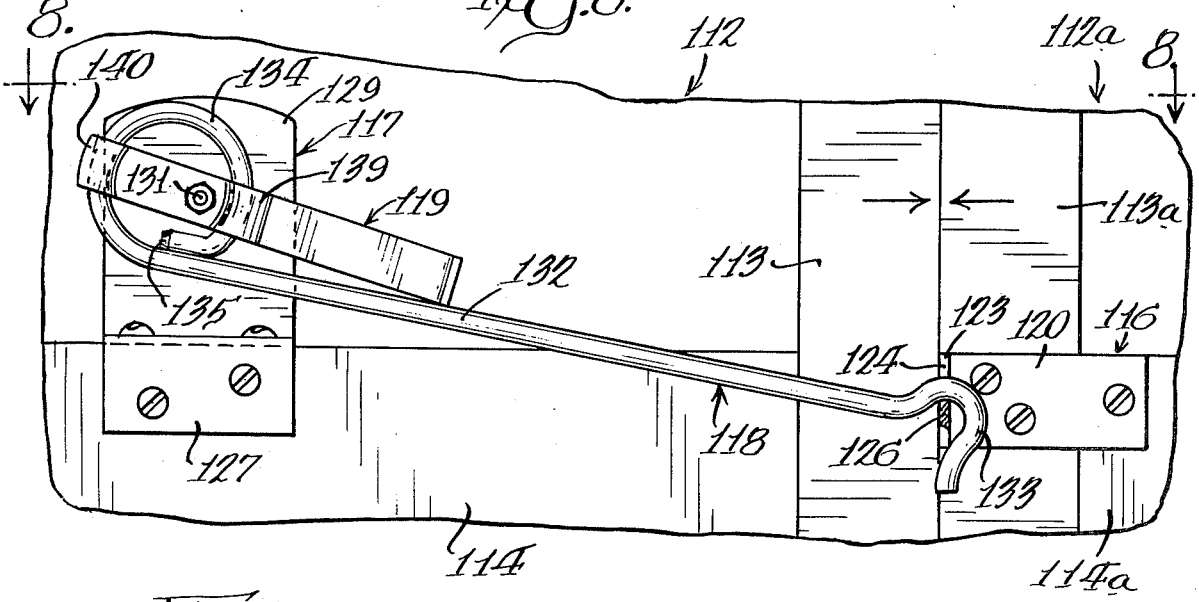
FIG. 6 is an elevational view of a second embodiment of the invention with the parts in the positions that they occupy when a pair of sliding doors is snugged together.
Figure 7:
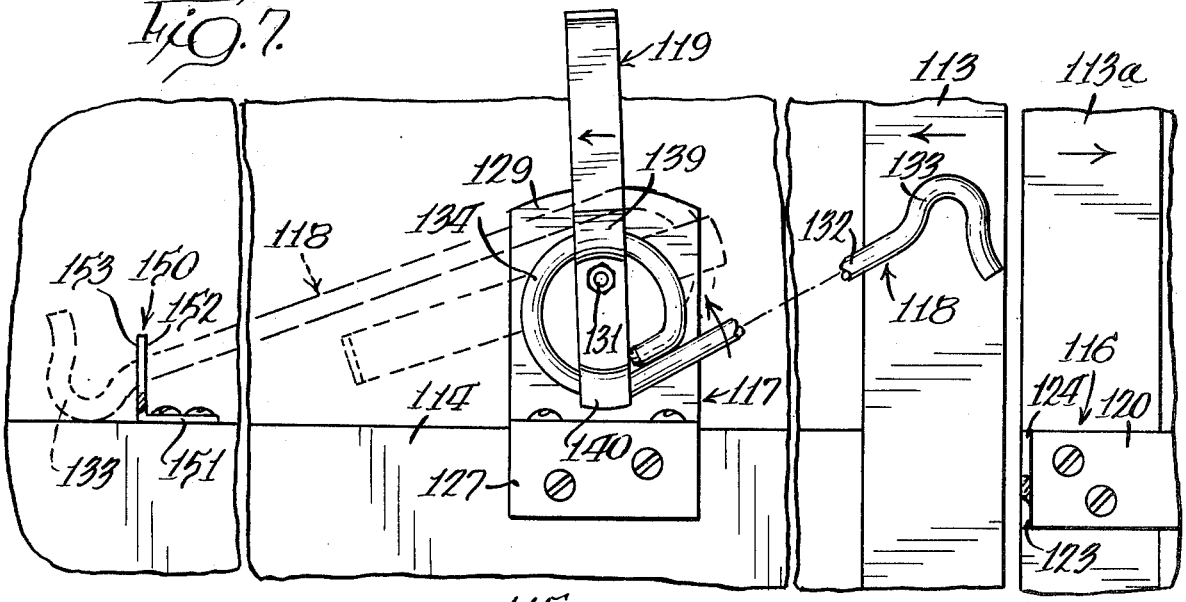
FIG. 7 is a fragmentary view similar to FIG. 6 which shows the hook and camming lever in the positions that they occupy when the hook is disengaged from the latch bar and moved part way to an idle position which is illustrated in broken lines.
Figure 8:
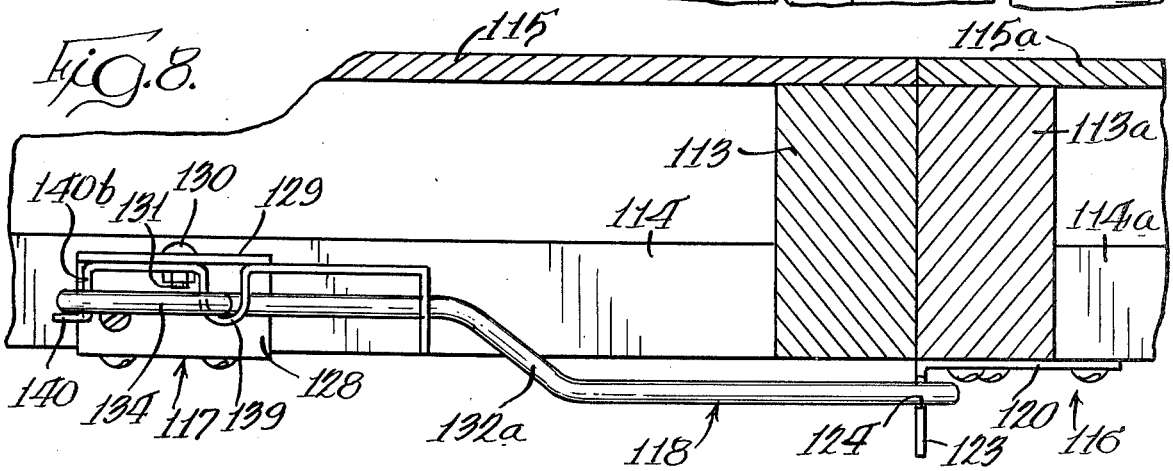
FIG. 8 is a fragmentary sectional view on an enlarged scale taken substantially as indicated along the line 8—8 of FIG. 6.

Referring now to FIGS. 6 to 8, the second embodiment of the invention there illustrated is used to snug a pair of double sliding doors 112 and 112*a* against each other. Each of the doors has a rectangular frame that includes a front upright member 113 or 113*a* and a transverse intermediate frame member 114 or 114*a.* Each frame is covered by an external sheet 115 or 115*a.*

The second embodiment of the invention, like the first, includes a latch catch, indicated generally at 116; a hook mounting bracket, indicated generally at 117; a hook, indicated generally at 118; and a camming lever, indicated generally at 119. While all of the foregoing elements function exactly as do the elements of the first embodiment, with the exception of the camming lever 119 each such element differs structurally from the corresponding element of the first embodiment. In addition, the second embodiment of the invention includes a support, indicated generally at 150, for the hook member 118.

The latch catch 116 is in the form of an angle member which has a mounting web 120 which is screwed to the upright front frame member 113a and to the transverse intermediate frame member 114*a* as seen in FIG. 8. Projecting inwardly from the web 120 is a web 123 which is provided with a notch 124 so that a portion 126 below the notch provides a fixed latch bar which is perpendicular to the plane of the doors 112 and 112a.

The hook mounting bracket 117 includes an upright flange 127 and a horizontal flange 128 by means of which the bracket 117 is screwed to the intermediate frame member 114. An upright web 129 is provided with a hole to receive a bolt 130 which provides a threaded stud 131, the head of the bolt 130 being welded to the web 129, and the threaded stud 131 being parallel to the latch bar 126 so that it, too, is perpendicular to the plane of the doors.

The hook member 118 is like the hook member 18 in that it has a shank 132 with a hook 133 at its forward end and a loop 134 at its rearward end. Likewise, the loop 134 is formed precisely the same as is the loop 34, with its end 135 similarly located. The hook member 118 differs from the hook member 18 by reason of having a longer shank and also, as seen in FIG. 8, by reason of the fact that the shank has an offset 132*a* so that the hook 133 may be aligned with the latch bar 126 although the loop 134 is recessed in the framework of the door.

The hook support 150 comprises an angle member having a fastening web 151 and an upright web 152 in which there is formed an upwardly open notch 153; and as seen in FIG. 7 the hook support 150 is so located with reference to the hook mounting bracket 117 that the portion of the hook shank 132 which is immediately adjacent the hook 133 rests in the notch 153. Reference to FIG. 8 shows that the bights of the camming lever 119 permit enough angular displacement of the hook member 118 relative to the plane of the door for the shank 132 to be received in the notch 153. The support 150 is entirely recessed forward of the inner face of the intermediate frame member 114 so that substantially the entire hook member 118 is also positioned above the intermediate frame member 114 when the hook member is in the idle position illustrated in broken lines in FIG. 7. Consequently, the hook member does not interfere with fully opening the door 112 because as seen in FIGS. 2 and 3, there is enough clearance between a door and the front of a structure side wall to accommodate a small projection of the shank 132 inwardly of the frame member 114.

Although the hook members and the camming levers are illustrated in the drawings as being mounted to swing in a vertical plane, it is quite apparent that the snugging operation would be the same if they were mounted to swing in a horizontal plane.

If the device of the invention is to be mounted exteriorly of a pair of sliding doors, conveniently the hook mounting bracket 17, the hook member 18 and the camming lever 19 of the first embodiment of the invention will be mounted upon one door, and the latch catch 116 of the second embodiment of the invention will be mounted upon the other door.

In the illustrated embodiments the loops 34 and 134 are circular and the camming levers 19 and 119 have their bights eccentrically positioned relative to the studs 31 and 131. However, it is to be noted that the same snugging action can be produced by a lever with bights concentric to the studs, if the loop has a flattened side which is to the rear of the stud when the hook member is engaged with the latch bar.

The foregoing detailed description is given for clearness of understanding only and no unnecessary limitations should be understood therefrom, as modifications will be obvious to those skilled in the art.

We claim:

1. Hook means for snugging a door of a structure comprising, in combination:

a fixed latch catch mounted on a door adjacent an upright side thereof;

a hook mounting bracket which has a body with an unobstructed planar outer surface provided with a generally centrally positioned stud, said bracket having flange means mounting it on a part of the structure with said body in spaced relationship to a surface of the structure so that when the door is closed the latch catch may be engaged by a hook member that is swingable about the stud;

a bar-like camming lever pivoted on said stud for movement in a first plane parallel to said planar outer surface, said camming lever having a first arm with a surface which is in immediate juxtaposition to said planar outer surface, said camming lever having two bights of predetermined depth which are effectively segments of a circle struck about a center on the lever that is spaced from the stud, both said bights projecting outwardly from said first plane and having open sides confronting the planar surface of the mounting bracket, one of said bights providing a camming surface, said camming lever also having an elongated manual manipulating arm that is in said first plane and extends a substantial distance laterally from the body of the bracket and a finger piece at the free end of said manipulating arm which extends outwardly from said first plane at least as far as said bights;

and a hook member which has a shank with a hook at its forward end to engage the latch catch, said hook member at its rearward end having a large loop received between said bights and said planar outer surface, the thickness of said hook member being substantially less than the depth of the bights so the hook is confined loosely to movement in a second plane which is outside said first plane and normal to the stud so that rotation of the lever in a predetermined direction causes the finger piece on the lever to engage the hook member shank for swinging the lever and the hook member together from an idle position toward the latch catch, said center on the lever being so located that after the hook is engaged with the latch catch continued rotation of the camming lever in said predetermined direction causes said camming surface to traverse the loop and move the hook member longitudinally rearwardly to snug the door toward the stud.

2. The combination of claim 1 in which the first and second planes are vertical, the camming lever and the hook member may be swung together until the hook member passes an upwardly extending position from which it swings by gravity until the hook engages the latch catch, said center then being below the pivot, and further pivotal movement of the camming lever toward said door causing the center to move to a location more remote from the door than is the pivot whereby during said further pivotal movement the engagement of the camming surface with the loop moves the hook member longitudinally rearwardly.

3. The combination of claim 1 in which the hook member is fabricated from metal rod, and the loop is formed with the extremity of the rod inside the loop against the shank of the hook member between said shank and the stud, so that when the hook member is engaged with the latch catch rotation of the camming lever opposite to said predetermined direction causes one of the bights to abut said extremity of the rod so continued rotation of the camming lever swings the hook member out of engagement with the latch catch and back toward its idle position.

4. The combination of claim 1 in which, when the hook is engaged with the latch bar before the door is drawn toward the stud, the distance from the stud to the rear of the loop is less than the distance from the stud to the camming surface of the lever whereby the hook member is moved rearwardly when the lever is swung toward the door and the camming surface traverses an arc away from the door.

5. The combination of claim 1 in which the latch catch has a hook engaging surface substantially parallel to the inner face of the door, and in which the hook mounting bracket is on a fixed portion of the structure.

6. The combination of claim 1 in which the door is a sliding door, the latch catch is mounted substantially parallel to the inner face of the door, and in which the hook mounting bracket is on a fixed portion of the structure.

7. The combination of claim 1 in which said one of the bights is at an end of the camming lever opposite the finger piece, the camming surface engages the rearward portion of the loop to draw the door toward the stud as the manipulating arm is rotated toward the door, and in which the finger piece rests on the shank of the hook member when the door is snugged.

8. The combination of claim 7 in which the lever rotates to an over center position immediately before the door is snugged, so that shaking of the door cannot impart reverse rotation to the lever and thereby release the snugging pull on the hook.

9. The combination of claim 8 in which the hook member is formed of metal rod which provides resilience in the loop sufficient to maintain snugging pull on the hook after the lever has passed over center.

10. The combination of claim 1 in which the door is one of a pair of sliding doors which abut when closed, the latch catch is mounted adjacent the abutting edge of the door and has a hook engaging surface substantially normal to the plane of the door, and in which the hook mounting bracket is mounted on the second door of said pair close to the abutting edge of said second door whereby the hook member swings parallel to the plane of said pair of doors.

11. The combination of claim 10 is which said pair of sliding doors have exposed internal horizontal frame members, and vertical frame members two of which abut when the doors are closed, the flange means mounts the bracket on top of a horizontal door frame member with the bracket body parallel to the plane of the doors and with said second plane recessed with respect to the inner surfaces of said two vertical frame members, and in which the shank of the hook member has an offset between the hook and the loop so the hook may engage the latch catch although the loop is recessed relative to said inner surfaces.

12. The combination of claim 11 in which the latch catch is secured to a transverse surface of the upright door frame member.

13. The combination of claim 11 which includes a support for the hook member that surmounts said horizontal door frame member to the rear of the stud, said support having an upwardly open slot, and in which the loop of the hook member is free to swing laterally in the bights so as to permit the shank of the hook member to rest in said slot in its idle position.

14. Hook means for snugging a door of a structure comprising, in combination:

a fixed latch catch mounted on a door adjacent an upright side thereof;

a hook mounting bracket which has a body with an unobstructed planar outer surface provided with a generally centrally positioned stud, said bracket having flange means mounting it on a part of the structure with said body in spaced relationship to a surface of the structure so that when the door is closed the latch catch may be engaged by a hook member that is swingable about the stud;

a bar-like camming lever pivoted on said stud for movement in a first plane parallel to said planar outer surface, said camming lever having a first arm with a surface which is in immediate juxtaposition to said planar outer surface, said camming lever having two bights of predetermined depth which are effectively segments of a circle struck about a center on the lever that is spaced from the stud, both said bights projecting outwardly from said first plane and having open sides confronting the planar surface of the mounting bracket, one of said bights providing a camming surface, and said camming lever also having an elongated manual manipulating arm that is in said first plane and extends substantial distance laterally from the body of the bracket;

and a hook member fabricated from metal rod which has a shank with a hook at its forward end to engage the latch catch, said hook member at its rearward end having a large loop received between said bights and said planar outer surface, said loop being formed with the extremity of the rod inside the loop against the shank of the hook member between said shank and the stud, the thickness of said metal rod being substantially less than the depth of the bights so the hook member is confined loosely to movement in a second plane which is outside said first plane and normal to the stud, said center on the lever being so located that after the hook is engaged with the latch catch rotation of the camming lever in a predetermined direction causes said camming surface to traverse the loop and move the hook member longitudinally rearwardly to snug the door toward the stud, and rotation of the camming lever opposite to said predetermined direction causes one of the bights to abut said extremity of the rod so continued rotation of the camming lever swings the hook member out of engagement with the latch catch and back toward its idle position.

* * * * *